US006724146B2

(12) United States Patent
Small

(10) Patent No.: US 6,724,146 B2
(45) Date of Patent: Apr. 20, 2004

(54) PHASED ARRAY SOURCE OF ELECTROMAGNETIC RADIATION

(75) Inventor: James G. Small, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 09/995,361

(22) Filed: Nov. 27, 2001

(65) Prior Publication Data

US 2003/0205960 A1 Nov. 6, 2003

(51) Int. Cl.[7] ..... H01J 25/55; H01J 25/56; H01J 25/593

(52) U.S. Cl. ..... 315/39.77; 315/39.73; 315/39.65; 315/39.75

(58) Field of Search ..... 315/39.77, 39.75, 315/39.73, 39.65, 39.51

(56) References Cited

U.S. PATENT DOCUMENTS

| | | | | |
|---|---|---|---|---|
| 2,432,466 A | * | 12/1947 | Burns | 315/39.73 |
| 2,462,510 A | | 2/1949 | Korman | |
| 2,635,211 A | * | 4/1953 | Crawford et al. | 315/39.73 |
| 3,860,880 A | | 1/1975 | Yariv et al. | |
| 4,410,833 A | | 10/1983 | Ganguly et al. | |
| 4,465,953 A | | 8/1984 | Bekefi | |
| 4,588,965 A | * | 5/1986 | Cook | 331/91 |
| 4,742,272 A | | 5/1988 | Kusano et al. | |
| 5,280,218 A | | 1/1994 | Smith | |
| 5,675,210 A | | 10/1997 | Kim | |
| 6,005,347 A | | 12/1999 | Lee | |
| 6,064,154 A | | 5/2000 | Crouch et al. | |
| 2002/0070671 A1 | | 6/2002 | Small | 315/39.51 |

FOREIGN PATENT DOCUMENTS

| | | | | |
|---|---|---|---|---|
| GB | 574.551 | | 1/1946 | |
| GB | 628.752 | | 9/1949 | |
| JP | 155530 | * | 6/1988 | 315/39.65 |

OTHER PUBLICATIONS

Partial International Search Report Re: PCT/US01/16622 mailed on Nov. 13, 2001 with Invitation to Pay Additional Fees.

International Search Report, Application No. PCT/US02/26689, Filing Date: Aug. 22, 2002.

International Search Report regarding International Application No. PCT/US02/26689 mailed Feb. 21, 2003.

* cited by examiner

*Primary Examiner*—Benny T. Lee
(74) *Attorney, Agent, or Firm*—Renner, Otto, Boisselle & Sklar LLP

(57) ABSTRACT

An electromagnetic radiation source is provided which includes an anode and a cathode separated by an anode-cathode space. The source further includes electrical contacts for applying a dc voltage between the anode and the cathode and establishing an electric field across the anode-cathode space. At least one magnet is arranged to provide a dc magnetic field within the anode-cathode space generally normal to the electric field. A plurality of openings are formed along a surface of the anode which defines the anode-cathode space, whereby electrons emitted from the cathode are influenced by the electric and magnetic fields to follow a path through the anode-cathode space and pass in close proximity to the openings. A common resonator receives electromagnetic radiation induced in the openings as a result of the electrons passing in close proximity to the openings, and reflects the electromagnetic radiation back towards the openings to produce oscillating electric fields across each of the openings at a desired operating frequency.

22 Claims, 10 Drawing Sheets

Upper Pole Piece Electrode 96

Lower Pole Piece Electrode 96

Upper Pole Piece Electrode 96

Lower Pole Piece Electrode 96

PHASED ARRAY SOURCE OF ELECTROMAGNETIC RADIATION

TECHNICAL FIELD

The present invention relates generally to electromagnetic radiation sources, and more particularly to a phased array source of electromagnetic radiation.

BACKGROUND OF THE INVENTION

Magnetrons are well known in the art. Magnetrons have long served as highly efficient sources of microwave energy. For example, magnetrons are commonly employed in microwave ovens to generate sufficient microwave energy for heating and cooking various foods. The use of magnetrons is desirable in that they operate with high efficiency, thus avoiding high costs associated with excess power consumption, heat dissipation, etc.

Microwave magnetrons employ a constant magnetic field to produce a rotating electron space charge. The space charge interacts with a plurality of microwave resonant cavities to generate microwave radiation. Heretofore, magnetrons have been generally limited to maximum operating frequencies below about 100 Gigahertz (Ghz). Higher frequency operation previously has not been considered practical for perhaps a variety of reasons. For example, extremely high magnetic fields would be required in order to scale a magnetron to very small dimensions. In addition, there would be considerable difficulty in fabricating very small microwave resonators. Such problems previously have made higher frequency magnetrons improbable and impractical.

Recently, the applicant has developed a magnetron that is suitable for operating at frequencies heretofore not possible with conventional magnetrons. This high frequency magnetron is capable of producing high efficiency, high power electromagnetic energy at frequencies within the infrared and visible light bands, and which may extend beyond into higher frequency bands such as ultraviolet, x-ray, etc. As a result, the magnetron may serve as a light source in a variety of applications such as long distance optical communications, commercial and industrial lighting, manufacturing, etc. Such magnetron is described in detail in commonly assigned, copending U.S. patent application Ser. No. 09/584,887, filed on Jun. 1, 2000, now U.S. Pat. No. 6,373,194, and Ser. No. 09/798,623, filed on Mar. 1, 2001, now U.S. Pat. No. 6,504,303, the entire disclosures of which are both incorporated herein by reference.

This high frequency magnetron is advantageous as it does not require extremely high magnetic fields. Rather, the magnetron preferably uses a magnetic field of more reasonable strength, and more preferably a magnetic field obtained from permanent magnets. The magnetic field strength determines the radius of rotation and angular velocity of the electron space charge within the interaction region between the cathode and the anode (also referred to herein as the anode-cathode space). The anode includes a plurality of small resonant cavities which are sized according to the desired operating wavelength. A mechanism is provided for constraining the plurality of resonant cavities to operate in what is known as a pi-mode. Specifically, each resonant cavity is constrained to oscillate pi-radians out of phase with the resonant cavities immediately adjacent thereto. An output coupler or coupler array is provided to couple optical radiation away from the resonant cavities in order to deliver useful output power.

Nevertheless, there remains a strong need in the art for even further advances in the development of high frequency electromagnetic radiation sources. For example, there remains a strong need for a device with fewer loss mechanisms and hence even further improved efficiency. More particularly, there is a strong need for a device which does not utilize a plurality of small resonant cavities. Such a device would offer greater design flexibility. Moreover, such a device would be particularly well suited for producing electromagnetic radiation at very short wavelengths.

SUMMARY OF THE INVENTION

A phased array source of electromagnetic radiation (referred to herein as a "phaser") is provided in accordance with the present invention. The phaser converts direct current (dc) electricity into single-frequency electromagnetic radiation. Its wavelength of operation may be in the microwave bands or infrared light or visible light bands, or even shorter wavelengths.

In the exemplary embodiments, the phaser includes an array of phasing lines and/or interdigital electrodes which are disposed around the outer circumference of an electron interaction space. During operation, oscillating electric fields appear in gaps between adjacent phasing lines/interdigital electrodes in the array. The electric fields are constrained to point in opposite directions in adjacent gaps, thus providing so-called "pi-mode" fields that are necessary for efficient magnetron operation.

An electron cloud rotates about an axis of symmetry within the interaction space. As the cloud rotates, the electron distribution becomes bunched on its outer surface forming spokes of electronic charge which resemble the teeth on a gear. The operating frequency of the phaser is determined by how rapidly the spokes pass from one gap to the next in one half of the oscillation period. The electron rotational velocity is determined primarily by the strength of a permanent magnetic field and the electric field which are applied to the interaction region. For very high frequency operation, the phasing lines/interdigital electrodes are spaced very closely to permit a large number of gap passings per second.

According to one particular aspect of the invention, an electromagnetic radiation source is provided. The source includes an anode and a cathode separated by an anode-cathode space. Electrical contacts are provided for applying a dc voltage between the anode and the cathode and establishing an electric field across the anode-cathode space. At least one magnet is arranged to provide a dc magnetic field within the anode-cathode space generally normal to the electric field. A plurality of openings are formed along a surface of the anode which defines the anode-cathode space, whereby electrons emitted from the cathode are influenced by the electric and magnetic fields to follow a path through the anode-cathode space and pass in close proximity to the openings. The source further includes a common resonator which receives electromagnetic radiation induced in the openings as a result of the electrons passing in close proximity to the openings, and which reflects the electromagnetic radiation back towards the openings and produces oscillating electric fields across each of the openings at a desired operating frequency.

According to another aspect of the invention, an electromagnetic radiation source is provided which includes an anode and a cathode separated by an anode-cathode space. The source further includes electrical contacts for applying a dc voltage between the anode and the cathode and establishing an electric field across the anode-cathode space. In addition, the source includes at least one magnet arranged to provide a dc magnetic field within the anode-cathode space generally normal to the electric field, and an array comprising N pin-like electrodes forming at least a part of the anode and arranged in a pattern to define the anode-cathode space. Furthermore, the source includes at least one common resonant cavity in proximity to the electrodes. The electrodes are spaced apart with openings therebetween, and electrons emitted from the cathode are influenced by the electric and magnetic fields to follow a path through the anode-cathode space and pass in close proximity to the openings to establish a resonant electromagnetic field within the common resonant cavity.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
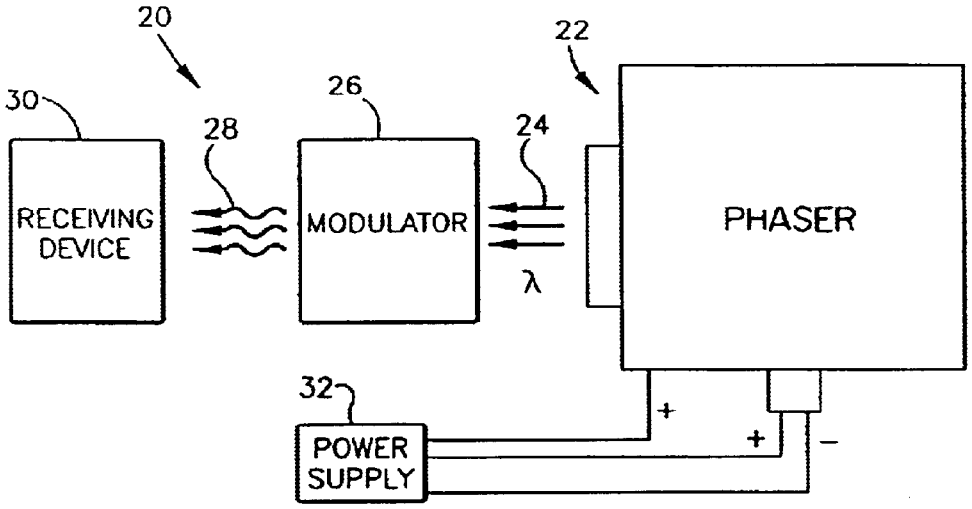
FIG. 1 is an environmental view of a phased array source of electromagnetic radiation (phaser) in accordance with the present invention as part of an optical communication system.

Referring initially to FIG. 1, a high frequency communication system 20 is shown. In accordance with the present invention, the communication system 20 includes a phased array source of electromagnetic radiation (phaser) 22. The phaser 22 serves as a high-efficiency source of high frequency electromagnetic radiation. Such radiation may be, for example, in the microwave bands or infrared light or visible light bands, or even shorter wavelengths. The output of the phaser 22 may be light used to communicate information optically from point-to-point. Although the phaser 22 is described herein in the context of its use in an optical band communication system 20, it will be appreciated that the phaser 22 has utility in a variety of other applications. The present invention contemplates any and all such applications.

As is shown in FIG. 1, the phaser 22 serves to output optical radiation 24 such as coherent light in the infrared, ultraviolet or visible light region, for example. The optical radiation is preferably radiation which has a wavelength $\lambda$ corresponding to a frequency of 100 Ghz or more. In a more particular embodiment, the phaser 22 outputs optical radiation having a wavelength in the range of about 10 microns to about 0.5 micron. According to an even more particular embodiment, the phaser 22 outputs optical radiation having a wavelength in the range of about 3.5 microns to about 1.5 microns. However, it will be appreciated that the phaser 22 has application even at frequencies substantially less 100 Ghz.

The optical radiation 24 produced by the phaser 22 passes through a modulator 26 which serves to modulate the radiation 24 using known techniques. For example, the modulator 26 may be an optical shutter which is computer controlled based on data to be communicated. The radiation 24 is selectively transmitted by the modulator 26 as modulated radiation 28. A receiving device 30 receives and subsequently demodulates the modulated radiation 28 in order to obtain the transmitted data.

The communication system 20 further includes a power supply 32 for providing an operating dc voltage to the phaser 22. As will be explained in more detail below, the phaser 22 operates on a dc voltage provided between the cathode and anode. In an exemplary embodiment, the operating voltage is on the order of 1 kilovolt (kV) to 4 kV. However, it will be appreciated that other operating voltages are also possible.

Figure 2:
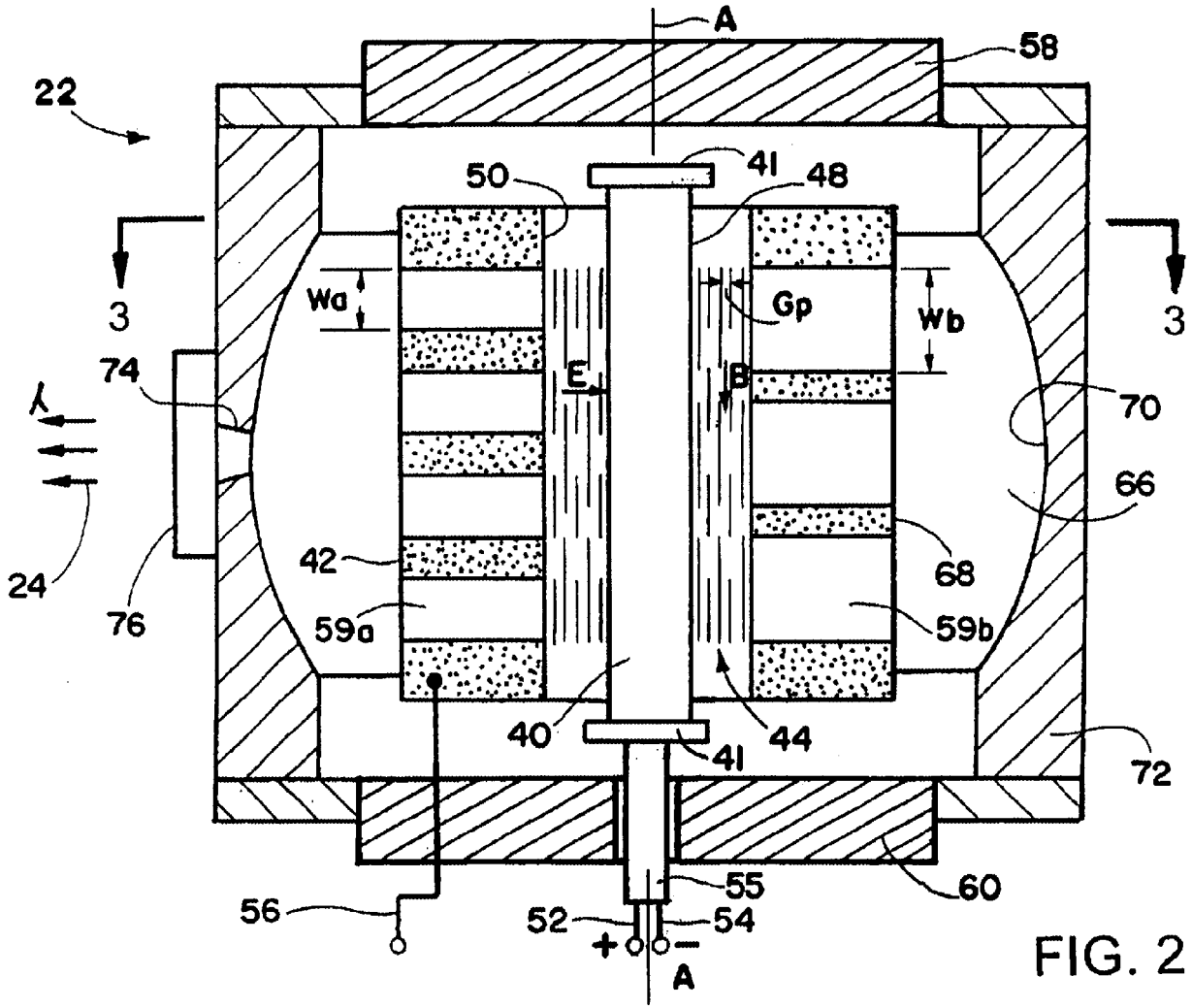
FIG. 2 is a cross-sectional view of a phaser including phasing lines in accordance with one embodiment of the present invention.
Figure 3:
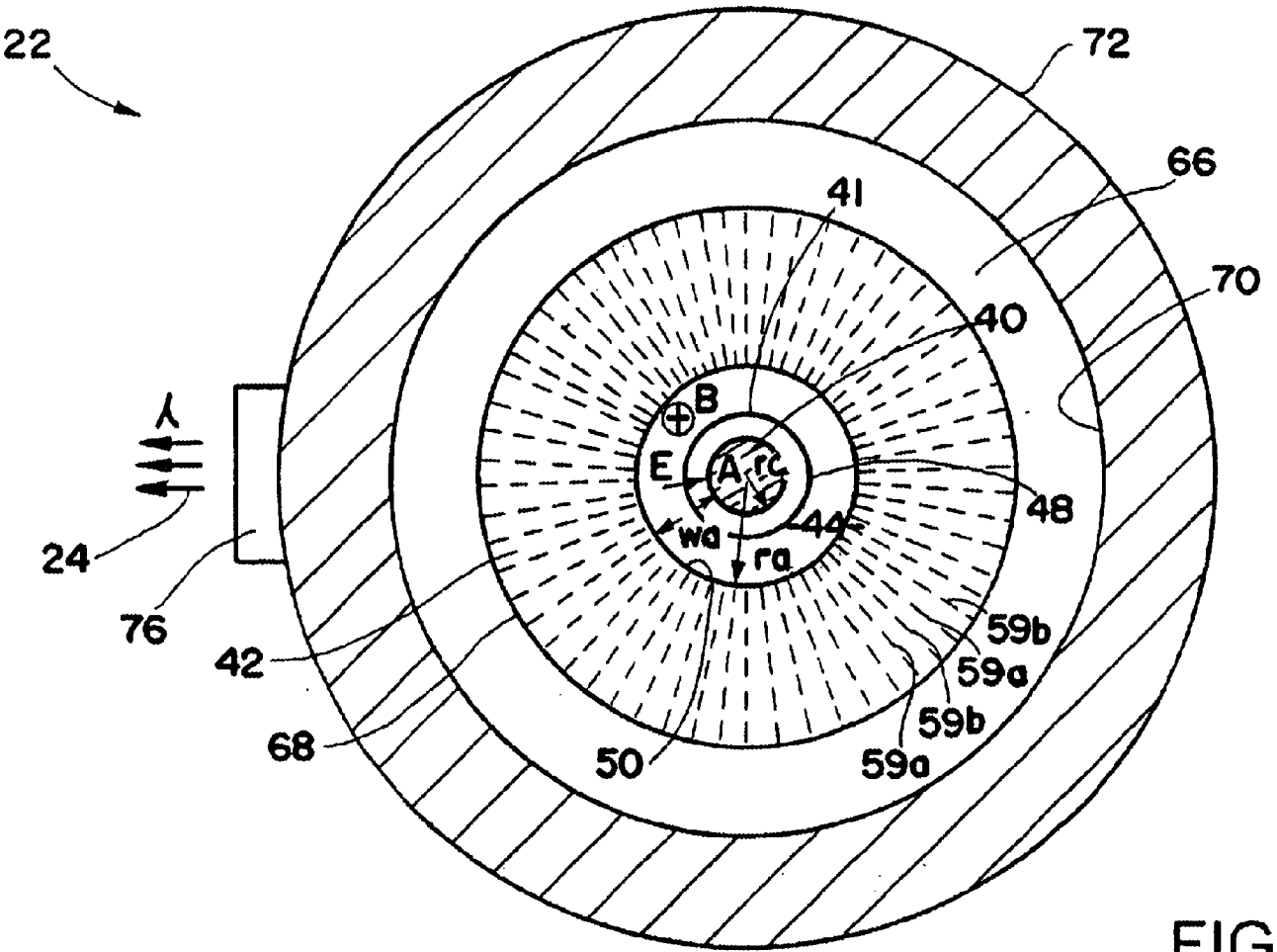
FIG. 3 is a cross-sectional top view of the phaser of FIG. 2 in accordance with the present invention, taken along line 3—3.

Referring now to FIGS. 2 and 3, a first embodiment of the phaser 22 is shown. The phaser 22 includes a cylindrically shaped cathode 40 having a radius rc (see, FIG. 3). Included at the respective ends of the cathode 40 are endcaps 41 . The cathode 40 is enclosed within a hollow-cylindrical shaped anode 42 which is aligned coaxially with the cathode 40 relative to axis A. The anode 42 has an inner radius ra (see. FIG. 3) which is greater than rc so as to define an electron interaction region or anode-cathode space 44 between an outer surface 48 of the cathode 40 and an inner surface 50 of the anode 42.

Terminals 52 and 54 respectively pass through an insulator 55 and are electrically connected to the cathode 40 to supply power to heat the cathode 40 and also to supply a negative (–) high voltage to the cathode 40 as seen in FIG. 2. The anode 42 is electrically connected to the positive (+) or ground terminal of the high voltage supply via terminal 56 (see, FIG. 2). During operation, the power supply 32 (FIG. 1) applies heater current to and from the cathode 40 via terminals 52 and 54. Simultaneously, the power supply 32 applies a dc voltage to the cathode 40 and anode 42 via terminals 54 and 56. The dc voltage produces a dc electric field E which extends radially between the cathode 40 and anode 42 throughout the anode-cathode space 44.

The phaser 22 further includes a pair of magnets 58 and 60 located at the respective ends of the anode 42 as seen in FIG. 2. The magnets 58 and 60 are configured to provide a dc magnetic field B (see, FIG. 2) in an axial direction which is normal to the electric field E throughout the anode-cathode space 44. As is shown in FIG. 3, the magnetic field B is into the page within the anode-cathode space 44. The magnets 58 and 60 in the exemplary embodiment are permanent magnets which produce a magnetic field B on the order of 2 kilogauss, for example. Other means for producing a magnetic field may be used instead (e.g., an electromagnet) as will be appreciated. However, one or more permanent magnets 58 and 60 are preferred particularly in the case where it is desirable that the phaser 22 provide some degree of portability, for example.

The crossed magnetic field B and electric field E influence electrons emitted from the cathode 40 to move in curved paths through the anode-cathode space 44. With a sufficient dc magnetic field B, the electrons will not arrive at the anode 42, but return instead to the cathode 40.

The anode 42 has formed therein an even-numbered array of straight single-mode waveguides 59*a* and 59*b* (represented in phantom in FIG. 3). The waveguides 59*a* and 59*b* function as respective phasing lines and have dimensions which are selected using conventional techniques such that the waveguides operate in single-mode at the desired operating wavelength λ. The waveguides 59*a* and 59*b* extend radially (relative to the axis A) from the anode-cathode space 44, thru the body of the anode 42, to a common resonant cavity 66. In particular, each of the waveguides 59*a* and 59*b* include an opening at the inner surface 50 of the anode 42 into the anode-cathode space 44. At the outer surface 68 of the anode 42, the waveguides 59*a* and 59*b* open into the common resonant cavity 66. The openings of the waveguides 59*a* and 59*b* are evenly and alternately spaced circumferentially along the inner and outer surfaces of the anode 42. The gap between openings along the inner surface 50 is represented by Gp as seem on FIG. 2.

As is represented in FIGS. 2 and 3, the waveguides 59*a* (nominally referred to herein as even-numbered waveguides) are relatively narrow waveguides compared to the waveguides 59*b* (nominally referred to herein as odd-numbered waveguides). The widths of the waveguides are selected such that the odd numbered waveguides 59*b* have a width Wb (see, FIG. 2) which is greater than the width Wa (also, FIG. 2) of the even numbered waveguides 59*a* so as to provide an additional ½-λ phase delay compared to the even-numbered waveguides 59*a* at the operating wavelength λ. In the exemplary embodiment, four even-numbered waveguides 59*a* are arranged side-by-side in the axial direction along axis A, and three of the wider odd-numbered waveguides 59*b* are similarly arranged. It will be appreciated, however, that the particular number of waveguides arranged in the axial direction is a matter of choice and may be different depending on desired output power, etc.

The common resonant cavity 66 is formed around the outer circumference of the anode 42, and is defined by the outer surface 68 of the anode 42 and a cavity defining wall 70 formed within a resonant cavity structure 72. The wall 70 is curved and forms a toroidal shaped resonant cavity 66. The radius of curvature of the wall 70 is on the order of 2.0 cm to 2.0 m, depending on the operating frequency.

As is shown in FIGS. 2 and 3, the resonant cavity structure 72 forms a cylindrical sleeve which fits around the anode 42. The resonant cavity 66 is positioned so as to be aligned with the outer openings of the respective waveguides 59*a* and 59*b*. The resonant cavity 66 serves to constrain the oscillations thru the respective waveguides 59*a* and 59*b* so as to operate in the pi-mode as is discussed more fully below.

In addition, the cavity structure 72 may serve to provide structural support and/or function as a main housing of the device 22. The cavity structure 72 also facilitates cooling the anode 42 in the event of high temperature operation.

The common resonant cavity 66 includes at least one or more output ports 74 (see, FIG. 2) which serve to couple energy from the resonant cavity 66 out through a transparent output window 76 as output optical radiation 24 (see, FIG. 2). The output port(s) 74 are formed by holes or slots provided through the wall of the resonant cavity structure 72.

The structure shown in FIGS. 2 and 3, together with the other embodiments described herein, is preferably constructed such that the anode-cathode space 44 and resonant cavity 66 are maintained within a vacuum. This prevents dust or debris from entering into the device and otherwise disturbing the operation thereof.

The resonant cavity 66 is designed using conventional techniques to have an allowed mode at the desired operating frequency (i.e., at the desired operating wavelength λ). Such techniques are known, for example, in connection with optical resonators conventionally used with laser devices. In the exemplary embodiment, the waveguides 59*a* and 59*b* are tapered waveguides. The waveguides 59*a* and 59*b* are designed to cut off frequencies which correspond to all possible resonant modes of the resonant cavity 66 below the desired operating frequency. In addition, the waveguides 59*a* and 59*b* are dimensioned to provide the aforementioned relative ½ wavelength phase difference at the operating frequency and only at that frequency.

The spacing Gp between openings of adjacent waveguides at the inner anode surface 50 is selected to optimize gain at the desired operating wavelength λ and to suppress oscillations at higher frequencies. The result is that a rotating electron cloud that is formed within the anode-cathode space 44 interacts with pi-mode electric fields at the inner anode surface 50, and pi-mode oscillation occurs.

More particularly, during operation power is supplied to the cathode 40 and anode 42. Electrons are emitted from the cathode 40 and follow the aforementioned curved paths through the anode-cathode space 44 and pass in close proximity to the openings of the waveguides 59*a* and 59*b*. As a result, an electromagnetic field is induced within the waveguides 59*a* and 59*b*. Electromagnetic radiation in turn travels through the waveguides 59*a* and 59*b* and enters the common resonant cavity 66. Electromagnetic radiation within the cavity 66 begins to resonate and is in turn coupled back through the waveguides 59*a* and 59*b* toward the anode-cathode space 44.

As a result, the electrons emitted from the cathode 40 tend to form a rotating electron cloud within the anode-cathode space 44. Oscillating electric fields appear in the gaps between the openings of the waveguides 59*a* and 59*b* at the inner surface 50 of the anode 42. Because the waveguides 59*a* and 59*b* are ½λ out-of-phase, the electric fields between the gaps are constrained to point in opposite directions with respect to adjacent gaps. Thus, the so-called "pi-mode" fields necessary for efficient magnetron-like operation are provided.

The electron cloud rotates about the axis A within the anode-cathode space 44. As the cloud rotates, the electron distribution becomes bunched on its outer surface forming spokes of electronic charge which resemble the teeth on a gear. The operating wavelength (equal to λ) of the phaser 22 is determined by how rapidly the spokes pass from one gap to the next in one half of the oscillation period. The electron rotational velocity is determined primarily by the strength of a permanent magnetic field and the electric field which are applied to the anode-cathode region 44. For very high frequency operation, the phasing lines formed by the waveguides 59*a* and 59*b* are spaced very closely to permit a large number of gap passings per second.

The total number N of waveguides 59*a* and 59*b* in the anode 42 is selected such that the electrons moving through the anode-cathode space 44 preferably are moving substantially slower than the speed of light c (e.g., approximately on the order of 0.1 c to 0.3 c). Preferably, the circumference 2 πra of the inner surface 50 of the anode is greater than λ, where λ represents the wavelength of the operating frequency As previously noted, the waveguides 59*a* and 59*b* are evenly spaced around the inner circumference of the anode 42, and the total number N is selected so as to be an even number in order to permit pi-mode operation.

In the above discussed embodiment of FIGS. 2 and 3, the waveguides 59*a* and 59*b* are oriented with their respective E-planes perpendicular to the axis A. The waveguides 59*a* and 59*b* are straight tapered waveguides, although it will be appreciated that the waveguides may instead be non-tapered. Moreover, differences in phase length between the respective waveguides may be carried out via other techniques such as providing curved waveguides 59*b* within the anode 42 versus forming the wider waveguides.

Exemplary dimensions for the anode 42 in an embodiment having non-tapered waveguides 59*a* and 59*b* are as follows:

| | |
|---|---|
| operating frequency: | 36.4 Ghz (λ = 8.24 mm = 0.324") |
| inner radius ra: | 4.5 mm = 0.177" |
| outer radius: | 24.04 mm = 0.9465" |
| waveguide 59a: | 0.254 mm × 5.32 mm (0.010" × 0.209") |
| waveguide 59b: | 0.254 mm × 7.67 mm (0.010" × 0.302") |
| number of waveguides along given circumference: | 148 |

As far as manufacture, the cathode 40 of the phaser 22 may be formed of any of a variety of electrically conductive metals as will be appreciated. The cathode 40 may be solid or simply plated with an electrically conductive and emissive material such as nickel, barium oxide or strontium oxide, or may be fabricated from a spiral wound thoriated tungsten filament, for example. Alternatively, a cold field emission cathode 40 which is constructed from micro structures such as carbon nanotubes may also be used.

The anode 42 is made of an electrically conductive metal and/or of a non-conductive material plated with a conductive layer such as copper, gold, aluminum or silver. The resonant cavity structure 72 may or may not be electrically conductive, with the exception of the walls of the resonant cavity 66 and output port(s) 74 which are either plated or formed with an electrically conductive material such as copper, gold or silver. The anode 42 and resonant cavity structure 72 may be formed separately or as a single integral piece as will be appreciated.

Figure 4A:
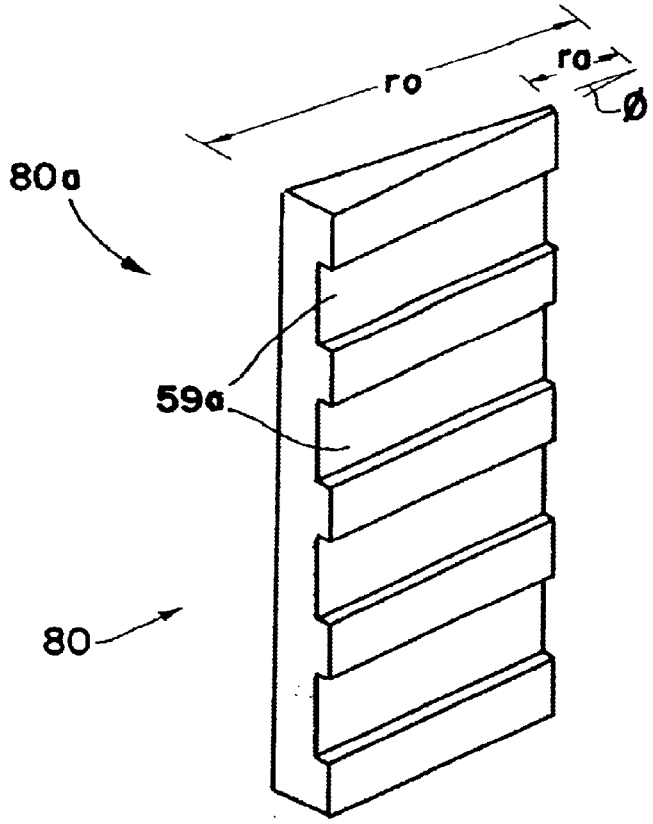
FIGS. 4*a* and 4*b* are perspective views of even-numbered wedges and odd-numbered wedges, respectively, which are suitable for forming an anode structure for the phaser of FIG. 2 in accordance with the present invention.
Figure 4B:
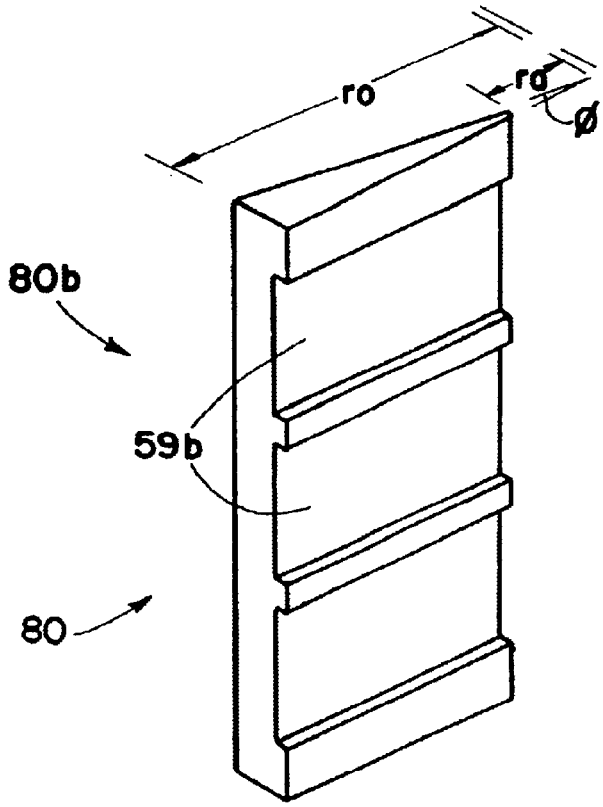

FIGS. 4*a* and 4*b* illustrate wedges that may be used to form the anode 42 in one embodiment of the invention. As is explained in the aforementioned U.S. Pat. No. 6,504,303, an anode similar to the anode 42 may be formed by a plurality of pie-shaped wedges. Likewise, the anode 42 may be formed by a combination of wedges 80*a* and 80*b* as shown in FIGS. 4*a* and 4*b*, respectively.

For example, the inner surface 50 of the anode 42 may include a plurality N of waveguide openings spaced circumferentially about a given axial point along the axis A. The number N and dimensions of the openings depends on the desired operating wavelength λ as discussed above. The anode 42 is formed by a plurality N of the pie-shaped wedge elements 80*a* and 80*b*, referred to herein generally as wedges 80. When stacked side by side, the wedges 80 form the structure of the anode 42.

FIGS. 4*a* and 4*b* represent perspective views of the wedge elements 80*a* and 80*b*. Each wedge 80 has an angular width φ equal to (2π/N) radians, and an inner radius of ra equal to the inner radius ra of the anode 42. The outer radius ro of the wedge 80 corresponds to the outer radius ro of the anode 42 (i.e., the radial distance to the outer surface 68. The front face of each wedge 80*a* has formed therein the bottom and side surfaces of the even-numbered waveguides 59*a*. Likewise, the front face of each wedge 80*b* has formed therein the bottom and side surfaces of the odd-numbered waveguides 59*b*.

A total of N/2 wedges 80*a* and N/2 wedges 80*b* are assembled together side-by-side in alternating fashion to form a complete anode 42 as represented in FIG. 3. The back face of each wedge 80 thus serves as the top surface of the waveguide formed in the adjacent wedge 80.

The wedges 80 may be made from various types of electrically conductive materials such as copper, aluminum, brass, etc., with plating (e.g., gold) if desired. Alternatively, the wedges 80 may be made of some non-conductive material which is plated with an electrically conductive material at least in the regions in which the waveguides 59*a* and 59*b* are formed.

The wedges 80 may be formed using any of a variety of known manufacturing or fabrication techniques. For example, the wedges 80 may be machined using a precision milling machine. Alternatively, laser cutting and/or milling devices may be used to form the wedges. As another alternative, lithographic techniques may be used to form the desired wedges. The use of such wedges allows precision control of the respective dimensions as desired.

After the wedges 80 have been formed, they are arranged in proper order (i.e., even-odd-even-odd . . . , etc.) to form the anode 42. The wedges 80 may be held in place by a corresponding jig, and the wedges soldered, brazed or otherwise bonded together to form an integral unit.

Figure 5:
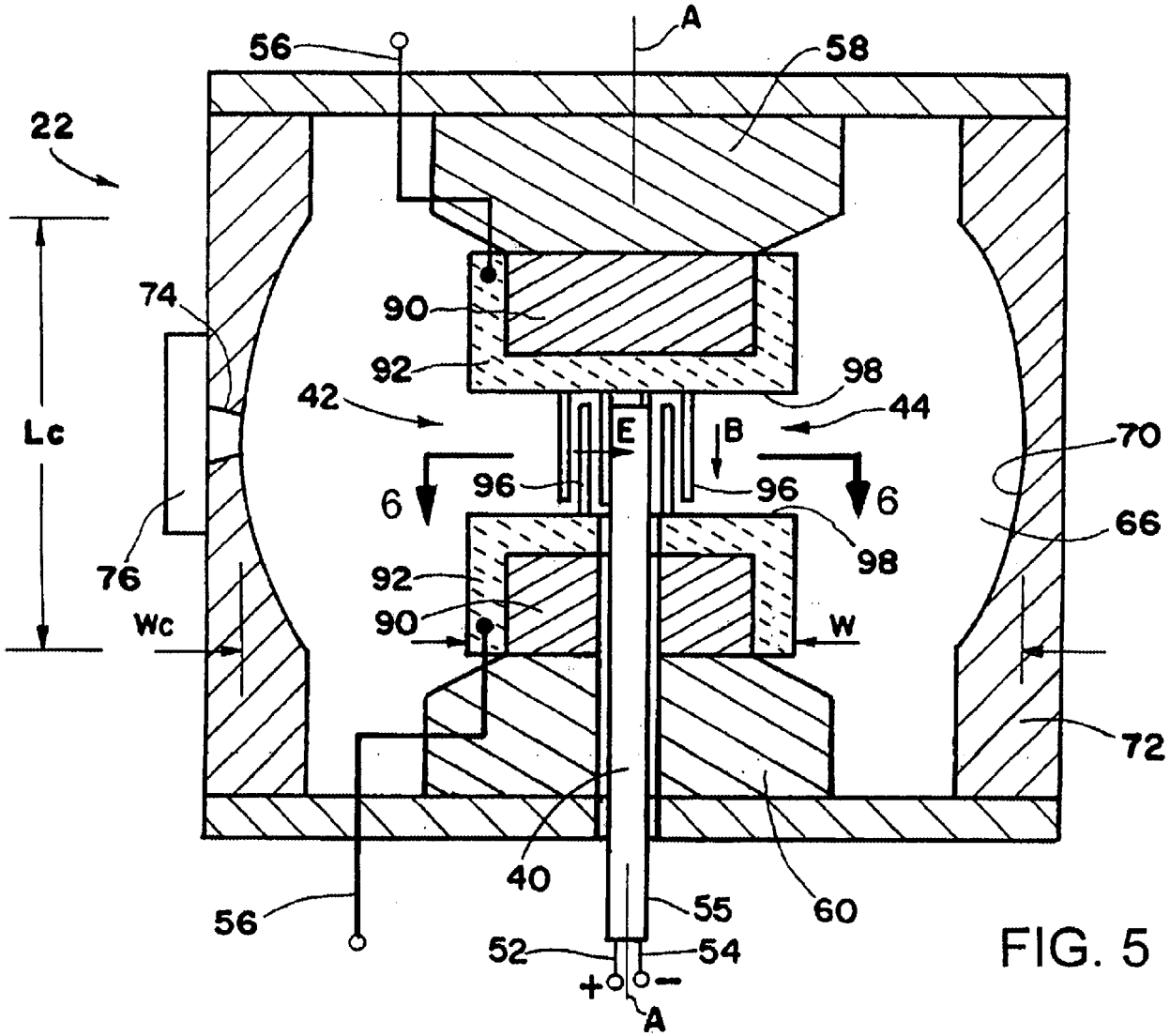
FIG. 5 is a cross-sectional view of a phaser with interdigital electrodes and a wide anode construction in accordance with another embodiment of the present invention.
Figure 6:
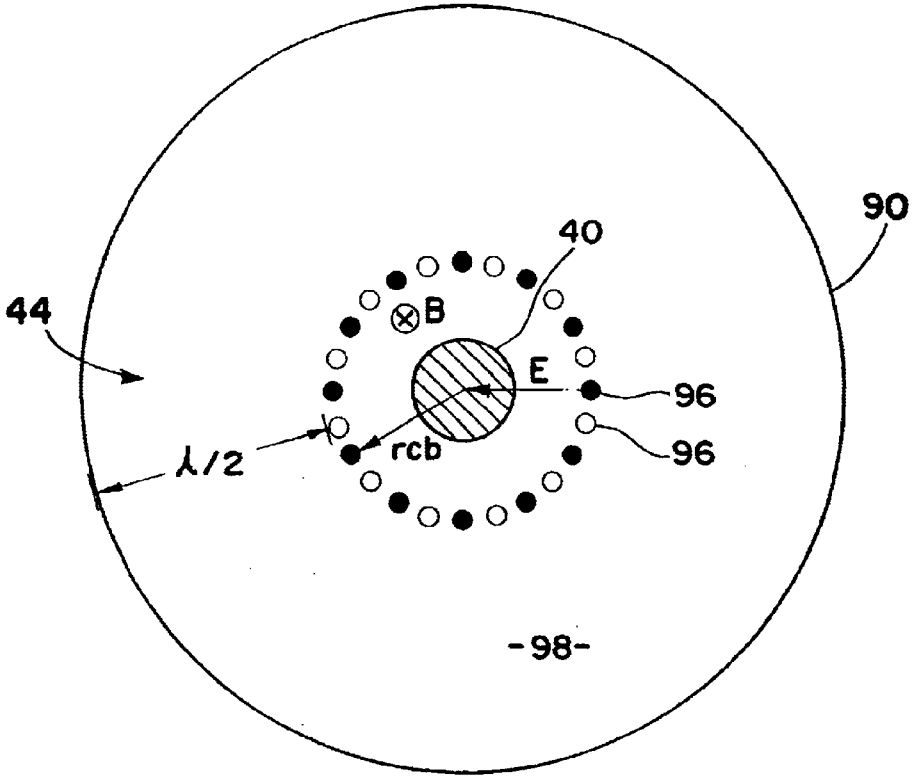
FIG. 6 is a cross-sectional top view of the interaction region of the phaser of FIG. 5 in accordance with the present invention, taken along line 6—6.

FIGS. 5 and 6 illustrate another embodiment of the phaser 22 having a different anode structure. More particularly, the phasing lines formed by the waveguides 59*a* and 59*b* in the previous embodiment are replaced by interdigital electrodes. The interdigital electrodes permit very fine electrode spacing independent of the operating wavelength λ. As there are many similarities between the respective embodiments described herein like reference numerals referring to like elements throughout), only the relevant differences will be discussed below for sake of brevity.

As is shown in FIGS. 5 and 6, the phaser 22 includes permanent magnets 58 and 60 for providing the cross magnetic field B as seen in FIG. 5. Mounted concentrically about the axis A on each of the magnets 58 and 60 is a corresponding cylindrical pole piece 90 made of iron or the like. Each of the pole pieces 90 includes a smooth, highly electrically conductive cladding 92 made of silver or the like. The pole pieces 90 are generally symmetric and face each other as shown in FIGS. 5 and 6. The width W of the pole pieces 90 and corresponding cladding 92 (see. FIG. 5) defines a relatively wide anode-cathode space 44 therebetween.

Figure 7:
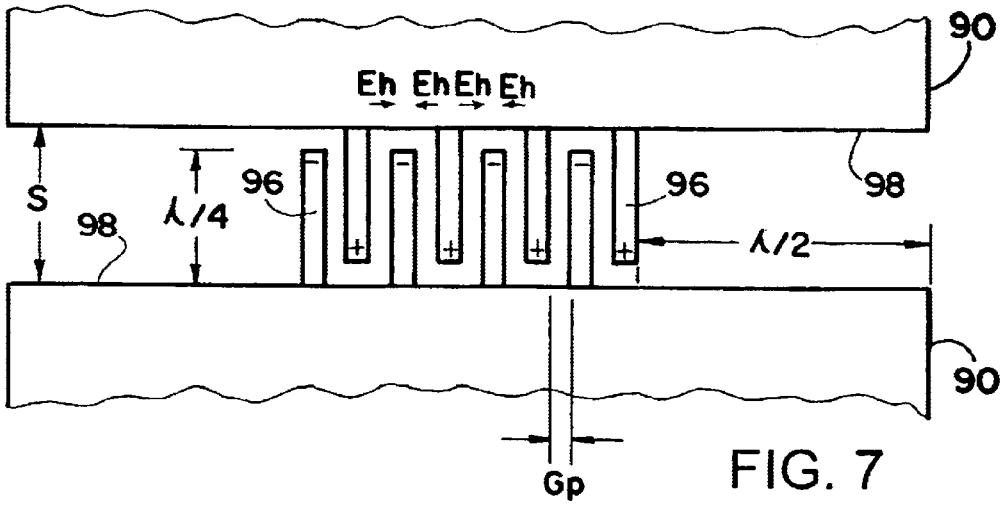
FIG. 7 is a schematic view of the interaction region of the phaser of FIG. 5 in accordance with the present invention.

In the exemplary embodiment, each pole piece 90 includes a plurality of electrodes 96 equally spaced about the circumference of a circle with a radius rcb from the axis A. The electrodes 96 in the exemplary embodiment are each formed by an electrically conductive pin made of silver, copper, or the like. The electrodes 96 may have a circular or square cross section, for example. The electrodes 96 have a length of ¼λ, where λ is again the wavelength at the desired operating frequency. The electrodes 96 are mechanically coupled to and extend from the base of the corresponding pole pieces 90 parallel with the axis A. In addition, the electrodes 96 from each pole piece 90 are electrically coupled to the pole piece 90 in this embodiment so as to remain electrically at the same electrical potential as the corresponding pole piece 90. Moreover, the electrodes 96 from the upper pole piece 90 are interdigitated with the electrodes 96 of the lower pole piece 90 as shown in FIG. 5. As a result, a cylindrical "cage" is formed about the cathode 40 in the anode-cathode space 44 defined between the respective pole pieces 90. Adjacent electrodes 96 from the different pole pieces are thus spaced from one another by a gap represented by Gp as shown in FIG. 7. It will be appreciated that the number of electrodes 96 shown in the figures is reduced for ease of illustration.

According to the embodiment of FIGS. 5–7, the radial distance from the electrodes 96 to the outer edge of the pole pieces 90 (inclusive of the cladding 92) is λ/2, for example (FIG. 7). The spacing S (see, FIG. 7) between the opposing faces 98 of the pole pieces 90 is slightly greater than λ/4 (to avoid electrode contact with the oppositely facing pole piece 90). As a result, the opposing faces 98 of the pole pieces 90 form a waveguide or parallel plate transmission line having a length along the radial direction of λ/2 which begins at the edge of the cylindrical cage formed by the electrodes 96 and opens into the common resonant cavity 66.

The cathode 40 extends along the axis A (e.g., through the lower magnet 60 and the pole piece 90) so as to be centered within the cage formed by the interdigital electrodes 96. As in the previous embodiment, terminals 52 and 54 respectively pass through an insulator 55 and are electrically connected to the cathode 40 to supply power to heat the cathode 40 and also to supply a negative (−) high voltage to the cathode 40. The respective pole pieces 90 in this embodiment are electrically connected to the positive (+) or ground terminal of the high voltage supply via terminal 56. During operation, the power supply 32 (FIG. 1) applies heater current to and from the cathode 40 via terminals 52 and 54. Simultaneously, the power supply 32 applies a dc voltage to the cathode 40 and anode 42 via terminals 54 and 56. The dc voltage produces a dc electric field E which extends radially between the cathode 40 and the electrodes 96 throughout the anode-cathode space 44.

Electrons are emitted from the cathode 40 and again follow the aforementioned curved paths through the orthogonal E field and B field in the anode-cathode space 44. The electrons in turn pass in close proximity to the electrodes 96 and induce opposite charges on adjacent electrodes 96 as represented in FIG. 7. The induced charges further induce an electromagnetic signal which radiates outward between the opposing faces 98 of the pole pieces 90 into the resonant cavity 66. The radiated electromagnetic signal is reflected by the resonant cavity 66 back towards the anode-cathode space 44 so as to reinforce the alternating charge which is induced on the adjacent electrodes 96.

In this manner, the energy within the phaser 22 begins to oscillate at the desired operating frequency in conjunction with the electron cloud which forms and rotates within the anode-cathode space 44. Standing-wave electromagnetic fields are established between the straight and curved surfaces of the toroidal resonant cavity 66. A portion of those fields are conducted inward between the opposing faces 98 of the pole pieces 90 toward the interdigital electrodes 96. At a specific instant of time during a cycle of oscillation, the standing-wave fields will cause the face 98 and electrodes 96 of the upper pole piece 90 to be charged negatively while the face 98 and electrodes 96 of the lower pole piece 90 are charged positively.

The resultant alternating positively and negatively charged interdigital electrodes 96 cause horizontal electric fields Eh to exist in the gaps between the electrodes 96 as represented in FIG. 7. As the standing-wave field reverses in time during the cycle of oscillation, the face 98 and electrodes 96 of the upper pole piece 90 become positively charged while the face 98 and electrodes 96 of the lower pole piece 90 become negatively charged. The horizontal electric fields Eh between the electrodes 96 thus reverse in direction during each cycle. These horizontal electric fields Eh thus become the pi-mode fields which interact with the rotating electron cloud within the anode-cathode space to produce oscillations within the phaser 22.

Figure 8:
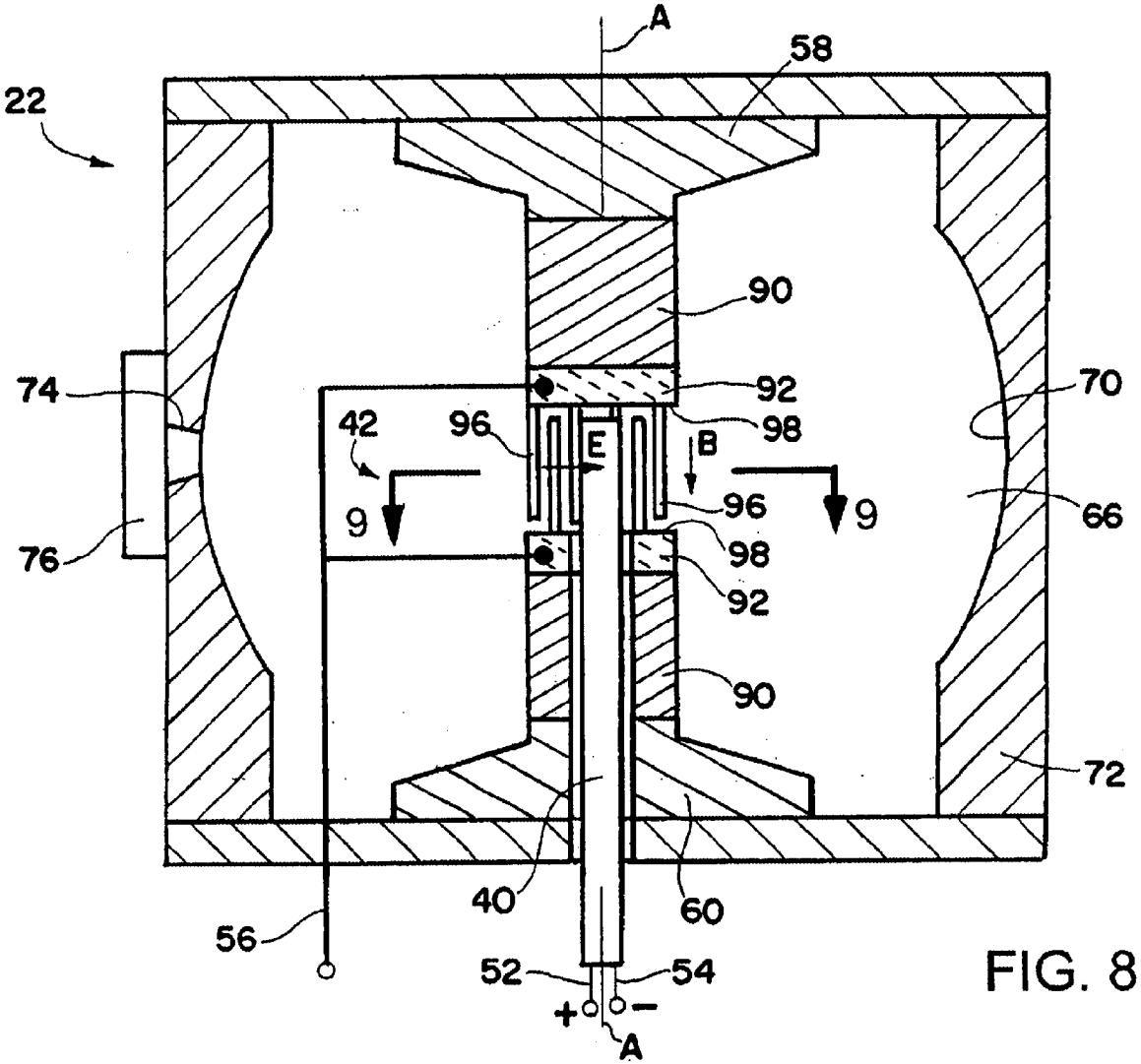
FIG. 8 is a cross-sectional view of a phaser with interdigital electrodes and a narrow anode construction in accordance with still another embodiment of the present invention.
Figure 9:
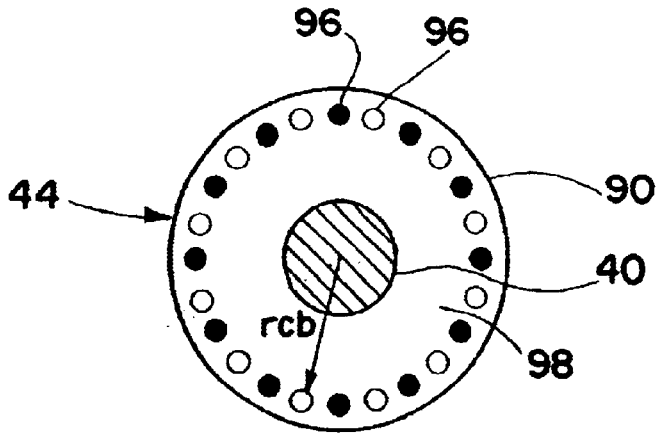
FIG. 9 is a cross-sectional top view of the interaction region of the phaser of FIG. 8 in accordance with the present invention, taken along line 9—9.
Figure 10:
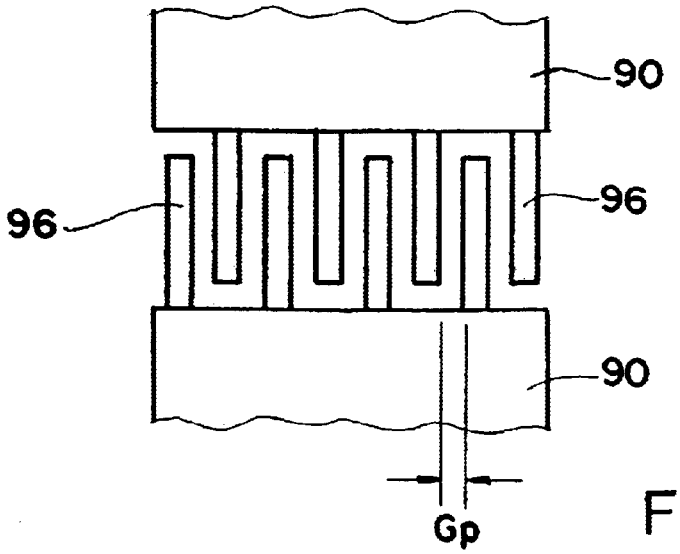
FIG. 10 is a schematic front view of the interaction region of the phaser of FIG. 8 in accordance with the present invention.

FIGS. 8–10 illustrate another embodiment of the phaser 22 (FIG. 8). As was shown in the previous embodiment of FIGS. 5–8, the phaser 22 illustrated in FIG. 8 includes a cathode 40 (FIG. 9), an anode 42, an anode-cathode space 44 (FIG. 9), terminals 52, 54, 56, permanent magnets 58, 60, a common resonant cavity 66, a cavity defining wall 70 formed within a resonant cavity structure 72, one or more output ports 74, a transparent output window 76. As shown in FIGS. 8–10, a cylindrical pole piece 90, a highly electrically conductive cladding 92 (FIG. 8), plurality of electrodes 96, and opposing faces 98 (FIGS. 8 and 9) of the pole pieces 90 (FIGS. 8 and 9).

In an embodiment according to FIGS. 5–7, exemplary dimensions and characteristics of the phaser 22 are as follows:

desired operating frequency: 10 Ghz diameter of pole pieces 90 (including cladding 92): 3.9 cm length Lc of resonant cavity 66: 8.86 cm width Wc of resonant cavity 66: 10.6 cm electrode 96 (pin) length: ¼λ number of electrodes 96: 40 (20 on upper pole piece; 20 on lower pole piece)

diameter of electrodes 96: 0.020 inch spacing between electrodes 96 (gap Gp): 0.010 inch.

The embodiment illustrated in FIGS. 8–10 is similar to the embodiment of FIGS. 5–7, with the exception that the wide anode structure 42 has been replaced with a narrow anode structure 42 (FIG. 8). Specifically, the diameter of the pole pieces 90 (including the cladding 92 of FIG. 8) is only slightly larger than the diameter (2×rcb) of the circle formed by the electrodes 96 as best shown in FIG. 9. Operation is similar to that described above with respect to the embodiment of FIGS. 5–7. However, in this embodiment the standing-wave fields in the resonant cavity 66 are applied directly to the interdigital electrodes 96 as shown in FIG. 8. There is no effective $\lambda/2$ waveguide or parallel plate transmission line between the "cage" formed by the electrodes 96 and the opening to the resonant cavity 66.

The narrow anode embodiment of FIGS. 8–10 is particularly useful for constructing a phaser 22 designed to operate at very short wavelengths. This narrow anode design facilitates forming multiple "cages" of interdigital electrodes 96 stacked atop one another along the axis A. Thus, even when the length of the cage pin electrodes 96 become very short at infrared and optical wavelengths, for example, the stacked cages provide a larger interaction surface area within the anode-cathode space 44.

Figure 11:
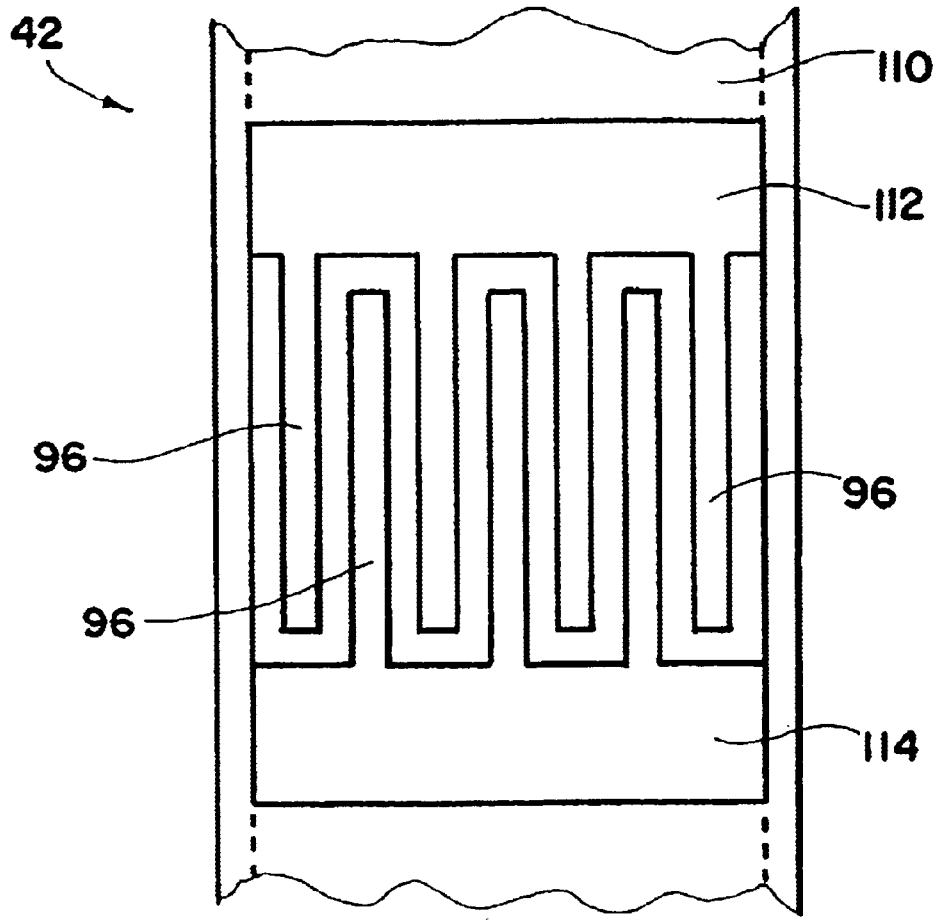
FIG. 11 is a schematic front view of an alternative embodiment of the anode configuration in accordance with the present invention.

Referring briefly to FIG. 11, an alternate embodiment of the anode 42 is shown in accordance with the present invention. The anode 42 includes a hollow cylindrical tube 110 made of glass or other type of dielectric material. The interdigital electrodes 96 are fabricated as metalized patterns on the inner surface of the tube 110. Thus, simple lithography techniques commonly used with the fabrication of semiconductor devices can be used to form fine, precision interdigital electrodes 96. The tube 110 is then place along the axis A of the phaser 22 so as to surround the cathode 40 and is located between the magnets 58 and 60 as represented in the other embodiments. The interdigital electrodes 96 each are coupled to ground or a positive dc voltage via respective upper and lower conductive rings 112 and 114 which also are patterned on the surface of the tube 110 along with the interdigital electrodes 96. The tube 110 serves as a support substrate for the electrodes 96 formed thereon, particularly at shorter wavelengths when the electrodes 96 become quite small.

In addition, the tube 110 can serve as an outer vacuum envelope. Outside the tube 110, the phaser 22 (e.g., resonant cavity 66) may be filled with air. Meanwhile, the interdigital electrodes 96 formed on the inner surface of the tube 110 are exposed to the vacuum and the rotating electrons emitted from the cathode 40. Air cooling against the outer wall of the tube 110 can be used to cool the interdigital electrodes 96 on the inner surface.

Thus, the tube 110 is convenient as it surrounds the cathode 40 and can be the only portion of the device 22 which contains a vacuum. The portions of the tube 110 which do not include the interdigital electrodes 96 may include a metalized film on the inner surface so as to be electromagnetically reflective as desired. The tube 110 with electrodes 96 and the anode 40 may be formed as a composite structure in much the same manner as linear light bulbs with electrical connections at the ends and a vacuum inside.

Figure 12:
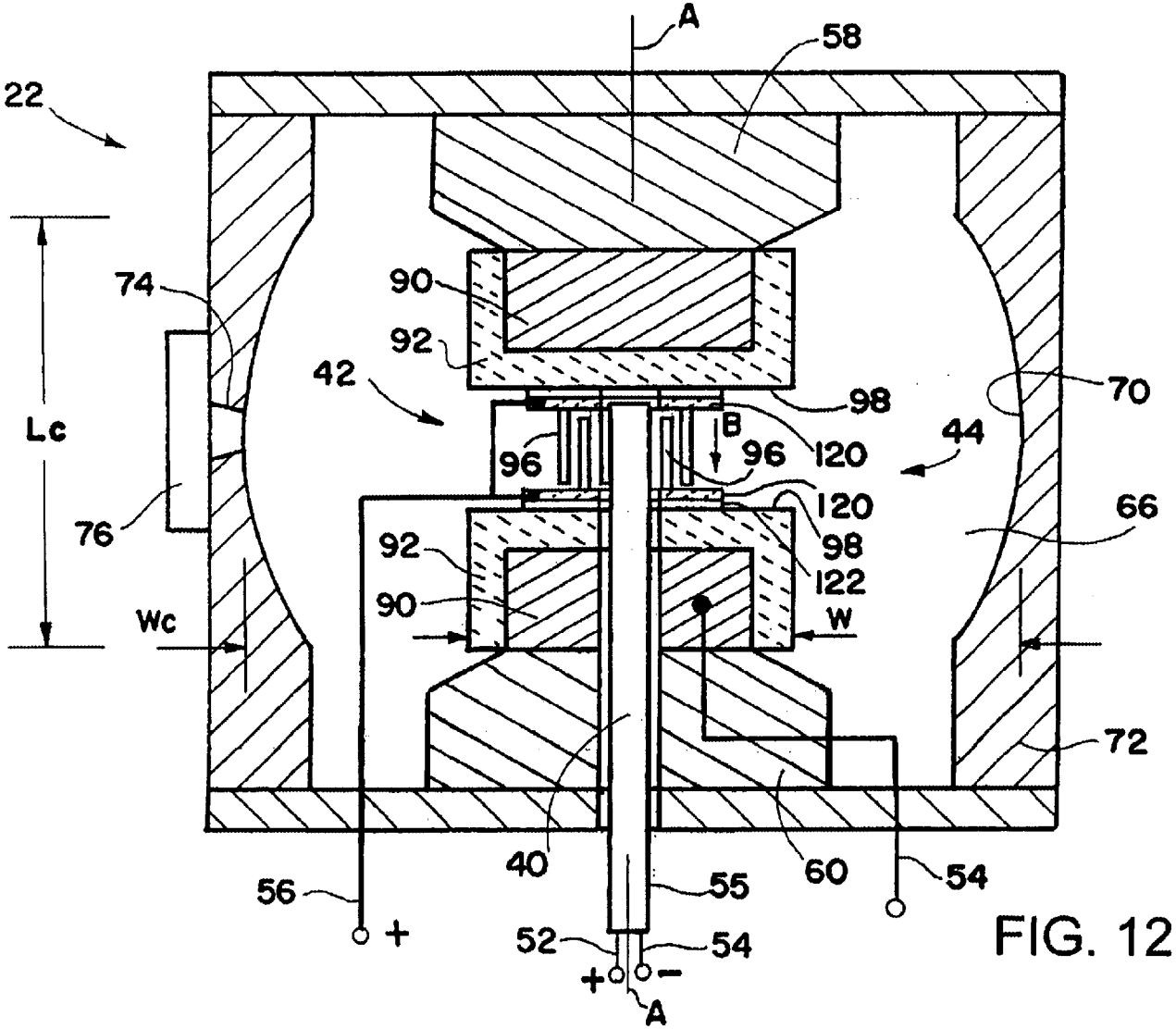
FIG. 12 is a cross-sectional view of a phaser with floating interdigital electrodes in accordance with another embodiment of the present invention.

FIG. 12 illustrates yet another embodiment of the phaser 22 in accordance with the present invention. The embodiment is similar to the embodiment of FIGS. 5–7 with the following exceptions. In this embodiment, the interdigital electrodes 96 are held at a positive high dc voltage and are isolated from the pole pieces 90. As is shown in FIG. 12, the interdigital electrodes 96 associated with each pole piece 90 are respectively formed on and extend from an electrically conductive ring 120. Each ring 120 is electrically isolated from its corresponding pole piece 90 by an insulating spacer 122.

Consequently, the interdigital electrodes 96 float electrically relative to the pole pieces 90. In operation, the electrodes 96 are connected electrically to a positive (+) high voltage supply via terminal 56 and the conductive rings 120. The pole pieces 90 are themselves coupled to the cathode ground via terminal 54. Again, the voltage difference between the cathode 40 and the interdigital electrodes 96 results in an E field which extends radially therebetween. Operation is again similar to the previous embodiments.

Although the floating interdigital electrode 96 embodiment of FIG. 12 is shown in accordance with a wide anode embodiment, it will be appreciated that the floating interdigital electrodes 96 could similarly be applied to the narrow anode embodiment of FIGS. 8–10 without departing from the scope of the invention. Moreover, another embodiment of the phaser 22 may utilize interdigital electrodes 96 with pole pieces 90 that are flared such that their surface 98 tapers away from the cage formed by the interdigital electrodes 96 in the radial direction.

Furthermore, the various embodiments of the anode 42 using interdigital electrodes 96 may include some electrodes 96 which extend completely between the respective pole pieces 90 so as to be in direct electrical contact with both pole pieces and/or conductive rings. Such connections provide increased DC continuity if desired.

It will be appreciated that the phaser 22 is described herein in the context of an anode structure which surrounds the cathode. In an alternate embodiment, the structure may be inverted. The anode may be surrounded by a cylindrical cathode. The present invention includes both inverted and non-inverted forms.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. An electromagnetic radiation source, comprising:

an anode and a cathode separated by an anode-cathode space;

electrical contacts for applying a dc voltage between the anode and the cathode and establishing an electric field across the anode-cathode space;

at least one magnet arranged to provide a dc magnetic field within the anode-cathode space generally normal to the electric field;

a plurality of waveguides within the anode respectively having anode-cathode space openings formed along a surface of the anode which defines the anode-cathode space, whereby electrons emitted from the cathode are influenced by the electric and magnetic fields to follow a path through the anode-cathode space and pass in close proximity to the anode-cathode space openings, and wherein the surface of the anode does not include openings to any resonant cavities other than a common resonator: and wherein the common resonator receives electromagnetic radiation induced in each of the anode-cathode space openings as a result of the electrons passing in close proximity to the anode-cathode space openings, and traveling through the respective waveguides into the common resonator via corresponding common resonator and openings of the waveguides, and wherein the common resonator reflects the electromagnetic radiation back towards the anode-cathode space openings and produces oscillating electric fields across each of the anode-cathode space openings at a desired operating frequency, and wherein the plurality of waveguides comprises waveguides having different electrical lengths to provide different phasing to the electromagnetic radiation passing therethrough.

2. The source of claim 1, wherein the oscillating electric fields of a particular opening are 180 degrees out of phase with respect to adjacent anode-cathode space openings.

3. The source of claim 1, wherein:

the cathode is cylindrical having a radius rc;

the anode is annular-shaped having a radius ra and is coaxially aligned with the cathode to define the anode-cathode space with a width wa=ra−rc; and a circumference 2 π ra of the surface of the anode is greater than λ, where λ represents the wavelength of the operating frequency.

4. The source of claim 1, wherein the anode comprises a plurality of wedges arranged side by side to provide a hollow-shaped cylinder having the anode-cathode space located therein, and each of the wedges comprises a first recess which defines at least in part a waveguide among the plurality of waveguides with an anode-cathode opening exposed to the anode-cathode space.

5. The source of claim 1, wherein the waveguides having different electrical lengths are comprised of waveguides having different dimensions.

6. The source of claim 5, wherein the different dimensions are in the H-plane.

7. The source of claim 5, wherein the different dimensions are a result of the waveguides having different lengths.

8. The source of claim 1, wherein the difference in electrical length between the plurality of wave guides is equal to about one-half λ, where λ represents the wavelength of the operating frequency.

9. An electromagnetic radiation source, comprising:

an anode and a cathode separated by an anode-cathode space;

electrical contacts respectively attached to the anode and cathode for applying a dc voltage between the anode and the cathode and establishing an electric field across the anode-cathode space;

at least one magnet arranged to provide a dc magnetic field within the anode-cathode space generally normal to the electric field;

an array comprising N pin-like electrodes providing at least a part of the anode and arranged in a pattern to define the anode-cathode space; and at least one common resonant cavity in proximity to the N electrodes, wherein the N electrodes are spaced apart with openings therebetween, and electrons emitted from the cathode are influenced by the electric and magnetic fields to follow a path through the anode-cathode space and pass in close proximity to the openings to establish a resonant electromagnetic field within the at least one common resonant cavity, and a circumference of the pattern of N electrodes defining the anode-cathode space being greater than λ, where λ represents the wavelength of the operating frequency of the electromagnetic radiation source.

10. The source of claim 9, wherein the cathode is generally cylindrically shaped about an axis, and the N electrodes provide at least one cylindrical cage coaxially around the cathode.

11. The source of claim 10, wherein the N electrodes are aligned parallel with the axis.

12. The source of claim 10, wherein N/2 of the electrodes originate from a lower part of the anode-cathode space and the remaining N/2 of the electrodes originate from an upper part of the anode-cathode space.

13. The source of claim 12, wherein the N/2 electrodes originating from the lower part of the anode-cathode space are interdigitated with the N/2 electrodes originating from the upper part of the anode-cathode space.

14. The source of claim 13, wherein the N electrodes are tied to a fixed dc potential to establish the electric field, and ac potentials are induced on the N electrodes by the resonant electromagnetic field.

15. The source of claim 14, wherein the ac potentials induced on adjacent interdigitated electrodes are respectively 180 degrees out-of-phase.

16. The source of claim 13, wherein the N electrodes are patterned from a conductive layer formed on a tube.

17. The source of claim 13, wherein the upper and lower parts of the anode-cathode space are respectively defined by upper and lower magnetic pole pieces.

18. The source of claim 17, wherein the N electrodes are electrically and mechanically coupled to a corresponding pole piece.

19. The source of claim 17, wherein the N electrodes are electrically isilated from a corresponding pole piece.

20. The source of claim 17, wherein the pole pieces define a waveguide between the N electrodes and the at least one common resonant cavity.

21. The source of claim 20, wherein the waveguide is approximately an integer multiple of λ/2 in length, where λ is the wavelength of the frequency of the resonant magnetic field.

22. The source of claim 10, wherein the at least one cylindrical cage includes a plurality of cylindrical cages, and the N electrodes provide the plurality of cylindrical cages coaxially around the cathode, the plurality of cylindrical cages being stacked one upon another.

* * * * *